US005152328A

United States Patent [19]

Arvidsson

[11] Patent Number: 5,152,328

[45] Date of Patent: Oct. 6, 1992

[54] FEED ROLLER

[75] Inventor: Hans Arvidsson, Grangärde, Sweden

[73] Assignee: Grangarde Maskin AB, Grangarde, Sweden

[21] Appl. No.: 757,268

[22] Filed: Sep. 10, 1991

[30] Foreign Application Priority Data

Sep. 24, 1990 [SE] Sweden ..... 9003020

[51] Int. Cl.[5] ..... B27B 31/00

[52] U.S. Cl. ..... 144/246 A; 144/246 R; 144/246 C; 144/250 R; 198/622; 198/624

[58] Field of Search ..... 198/622, 624; 144/246 R, 246 A, 246 C, 250 R, 250 A, 362

[56] References Cited

U.S. PATENT DOCUMENTS

| | | | |
|---|---|---|---|
| 1,629,642 | 5/1927 | Shurmer | 144/250 A |
| 4,385,650 | 5/1983 | Schmidt | 144/246 C |
| 4,901,778 | 2/1990 | Fenton | 144/246 R |
| 4,972,890 | 11/1990 | Isley | 144/246 C |

*Primary Examiner*—W. Donald Bray
*Attorney, Agent, or Firm*—Robert G. Mentag

[57] ABSTRACT

A feed roller intended for a timber processing unit includes a roller body having disposed on its outer periphery elastically supported engagement devices for driving engagement with a tree trunk advanced by the roller. In accordance with the invention, it is proposed that the engagement devices include mutually separated elements (20) and that each of the elements is moveably connected to the roller body (10) at its outer periphery.

6 Claims, 2 Drawing Sheets

FEED ROLLER

The present invention relates to a feed roller for a timber processing unit, comprising a roller body and an elastically supported engagement means mounted on the outer periphery of the roller body and intended for driving engagement with a tree trunk advanced by the roller.

Known feed rollers of this kind consist, in principle, of a rubber wheel provided with engagement means or slip protectors in the form of chain links. Although such a feed roller acts gently on the log and, to some extent, is able to adapt to irregularities in the log surface, the rubber ring on the roller becomes worn relatively quickly as a result of rubbing against the log and the chain links. Another drawback is that the chain links are not always able to maintain satisfactory driving engagement with the tree trunk, particularly in the period of sap flow during which the bark has low adherence to the trunk and is easily removed therefrom.

An object of the present invention is to provide an improved feed roller of the aforesaid kind.

This object is achieved with a feed roller having the characteristic features set forth in the following claims.

Because the engagement devices include separate elements which are each moveably connected to the roller body at the outer periphery thereof, the engagement devices, as distinct from chain links, are prevented from performing sliding and wearing movements against the elastic support, such that said support will be subjected generally to solely pressure and shear forces. The presence of such individually elastically mounted elements also enables engagement with the periphery of the tree trunk to be better controlled.

An exemplifying embodiment of the invention will now be described in greater detail with reference to the accompanying drawings, in which FIG. 1 is a side view of part of a feed roller constructed in accordance with the invention;

Figure 1:
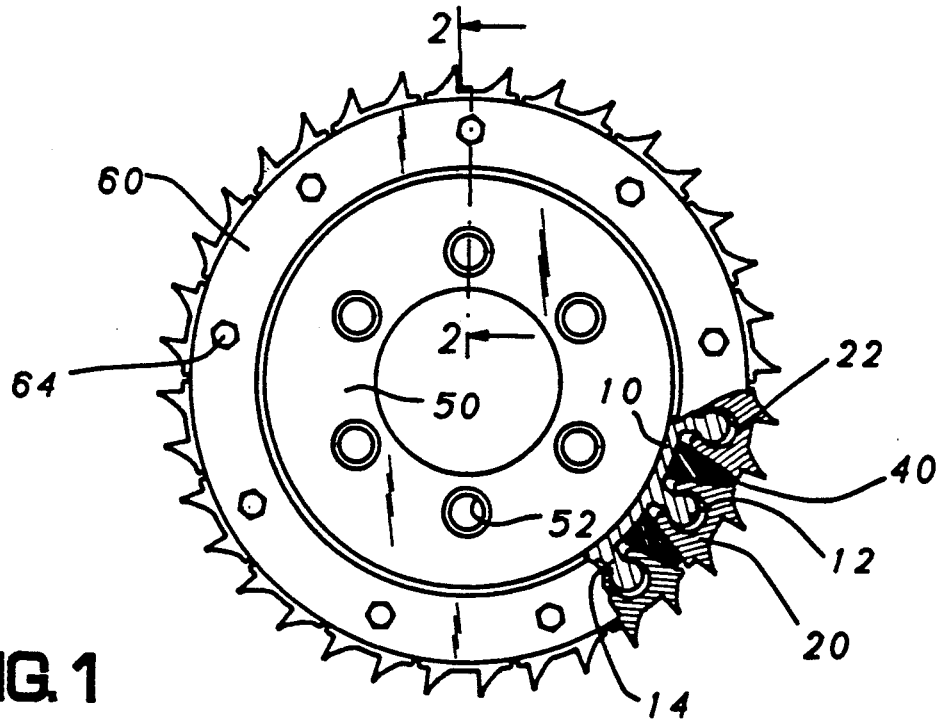

The feed roller shown by way of example in the drawings is intended for use in a crane-carried single-grip type harvesting unit. It will be understood, however, that the invention is not restricted thereto, but can also be applied with other types of feed rollers, for example the feed rollers of sawmills.

The illustrated feed roller includes a roller body 10 which has mounted on the periphery thereof a plurality of drive elements 20 between which are disposed, in turn, a plurality of spring elements 40. The feed roller also includes a hub disc or plate 50 and a pair of side plates 60. The roller body 10 and the drive elements 20 are preferably manufactured from extruded aluminium, whereas the hub plate 50 may be manufactured from laser-cut or punched aluminium plate and the side plates 60 from steel plate.

Figure 3:
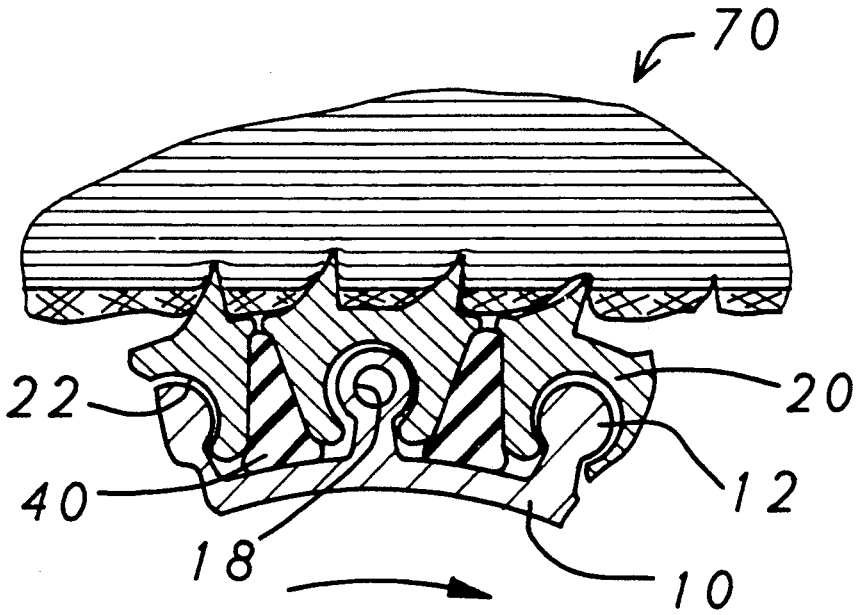
FIG. 3 is a part section view of a feed roller, taken approximately along the line 3—3 in FIG. 2.
Figure 4:
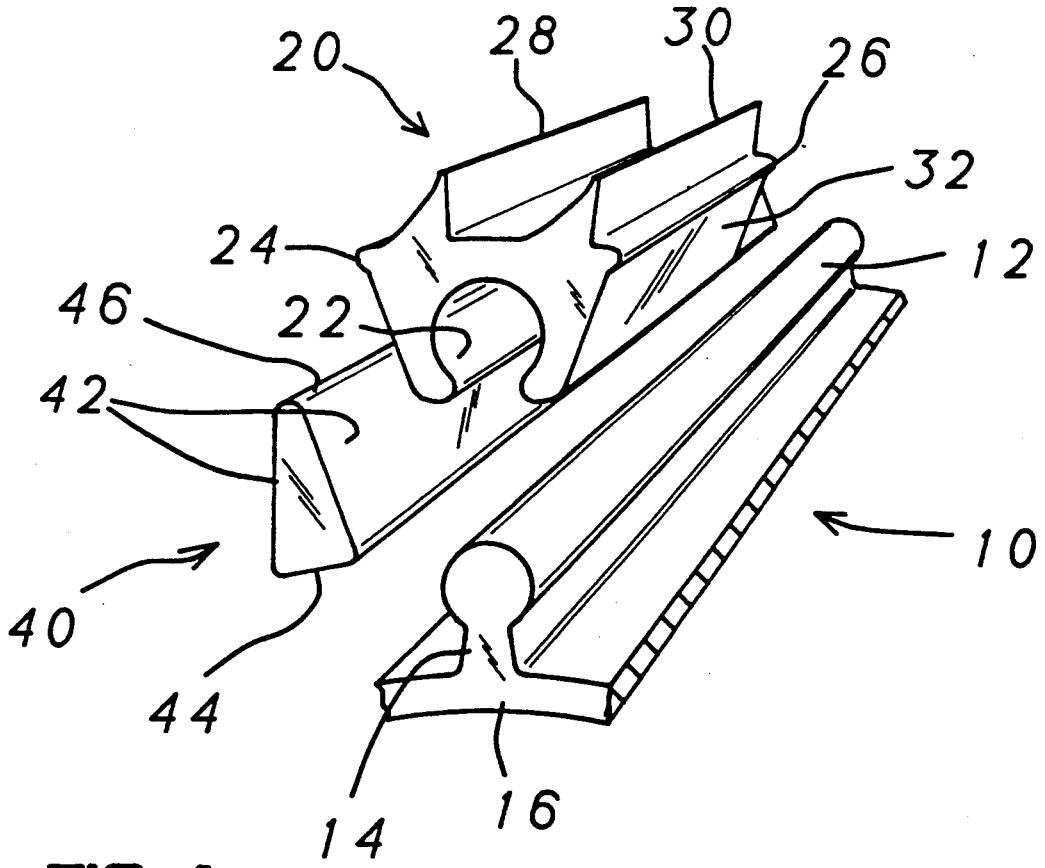
FIG. 4 is a perspective view of a drive element, a spring element and part of an inventive roller body, said elements and said part being shown separated from one another.

As will best be seen from FIGS. 3 and 4, the drive elements 20 are intended to be connected to the roller body 10 with the aid of groove joints which have the form of mutually complementary cylindrical surfaces at 22 and 12 respectively. More specifically, when seen in cross-section, arranged around the periphery of the roller body 10 are circular projections 12 which are connected integrally with the main part 16 of the roller body 10 through the intermediary of a flanged web 14. As will be seen from FIG. 3, the recesses 22 in the drive elements 20 are complementary to the circular projections 12, and they have a diameter which is greater than the diameter of the projections 12, as will be explained in more detail below.

The spring elements 40 are produced from an appropriate extruded rubber material and have a wedge-shaped cross-section, wherein the wedge-shaped surfaces 42 of said spring elements abut with similarly wedge-shaped outer sides 32 of the adjacent drive elements 20. The bottom surfaces 44 of the spring elements 40 rest against the outer surface of the main part 16 of the roller body 10. Abutting the rounded top of each spring element is a projection 24, 26 formed on the outer sides of the drive elements 20. Each drive element is provided on its upper side with a pair of mutually spaced, pointed engagement edges 28, 30 (FIG. 4), which may also be provided with recesses 36 so as to form a plurality of drive teeth 34, as shown in FIG. 2.

Figure 2:
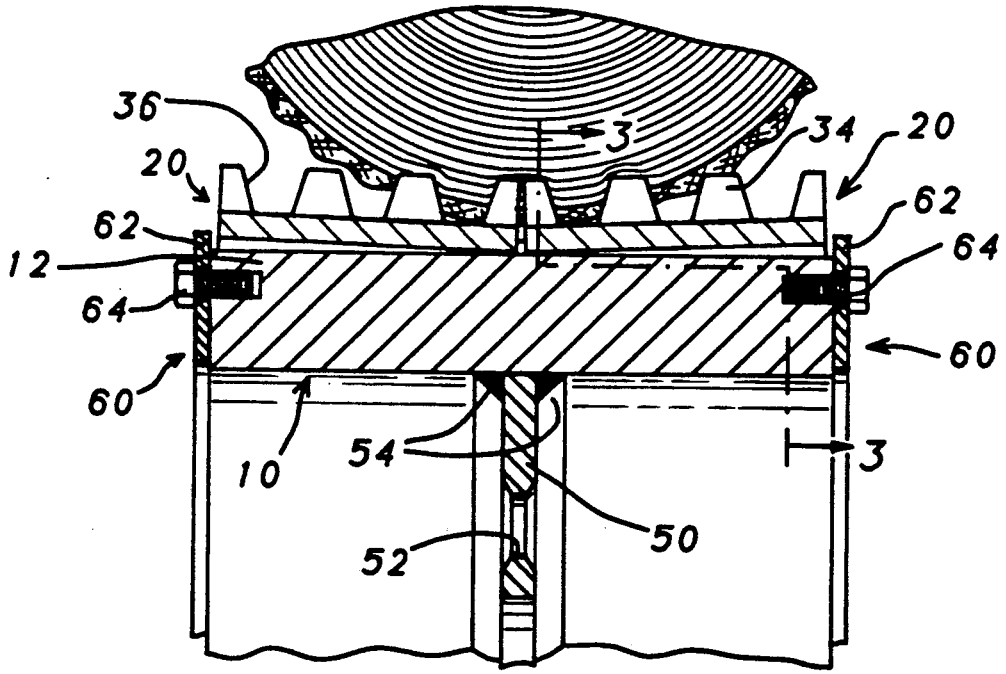
FIG. 2 is a sectional view, in larger scale, of a feed roller under load, said section being taken on the line 2—2 in FIG. 1.

It will also be seen from FIG. 2 that at least two drive elements 20 can be fitted on each projection 12.

The drive elements 20 and the rubber elements 40 are held in position on the roller body 10 by means of the two annular side walls 60, the radially outer parts 62 of which (FIG. 2) prevent the drive elements 20 and the spring elements 40 from sliding off the roller body 10. The side walls 60 are connected to the roller body 10 by means of screws 64, which are screwed firmly into screw-threaded holes 18 (FIG. 3) on the circular projections 12 of the roller body 10.

As shown in FIG. 2, the annular hub plate 50 is connected to the roller body 10 by means of a welded joint 54 and is provided with a plurality of attachment holes 52 for attachment of a drive hub (not shown) of a hydraulic motor, for instance.

In the non-loaded state of the feed roll (shown in FIG. 1), the drive elements 20 are biased radially outwards by the spring elements 40, so that the recesses 22, at their openings, abut the projections 12 of the roller body in the vicinity of the flange webs 14. Because the recesses 22 are wider, or have a greater diameter than the projections 12 when subjected to load, the drive elements 20 are able to move to a limited extent relative to the projections 12, against the action of the spring force exerted by the spring elements 40. As will be seen from FIG. 3, which illustrates a number of drive elements subjected to load by a tree trunk 70, these movements may include both limited translatory movements and limited pivotal movements around associated projections or arms 12.

Because the drive elements 20 are elastically mounted in the roller body 10, in the aforedescribed manner, the drive teeth are able to adapt to irregularities in the periphery of the tree trunk and therewith improve the driving engagement of said teeth, as distinct to the case of a so-called spiked roller for instance, in which the drive elements are connected rigidly to the roller.

I claim:

1. A tree trunk feed roller for use in a timber processing unit, comprising:

(a) a roller body (10), provided with a drive hub disc (50), and having mounted around the outer periphery thereof a plurality of peripherally spaced apart, rigid projections (12);

(b) a rigid drive element (20) moveably mounted on each of said rigid projections (12) for driving engagement with a tree trunk;

(c) an elastic support means (40) mounted on the outer periphery of the roller body (10) between each adjacent pair of said rigid drive elements (20) in an abutting relationship; and, (d) retainer means (60) mounted on each side of the roller body (10) for a retaining engagement with the rigid drive elements and elastic support means (40).

2. A tree trunk feed roller as defined in claim 1, wherein:

(a) each of said elastic support means comprises a separate spring element (40).

3. A tree trunk feed roller as defined in claim 2, wherein:

(a) each of said separate spring elements (40) are made from an elastomeric material.

4. A tree trunk fee roller as defined in claim 2, wherein:

(a) each of the rigid drive elements (20) is formed with wedge-shaped outer side surfaces (32); and, (b) each of the spring elements (40) has a wedge-shaped cross section with wedge-shaped outer side surfaces (42) that abut the wedge-shaped outer side surfaces (32) of the adjacent rigid drive elements (20).

5. A tree trunk feed roller as defined in claim 1, wherein:

(a) each of the drive elements (20) is movably mounted on one of the rigid projections (12) on the roller body (10) by a pair of complementary groove joint members comprising a circular connecting surface on one of the groove joint members and a cylindrical connecting surface on the other groove joint member.

6. A tree trunk feed roller as defined in claim 5, wherein:

(a) said circular connecting surface on said one of said groove joint members has a diameter greater than the diameter of the cylindrical connecting surface on said other groove joint members, whereby when the feed roller is in a non-loaded state the drive elements (20) are biased radially outwards by the spring elements (40), and when the drive elements (20) are subjected to a load by a tree trunk (70) the drive elements (20) are able to make both limited translatory and pivotal movements relative to the rigid projections (12).

* * * * *